US010995460B1

(12) United States Patent
Hirman et al.

(10) Patent No.: US 10,995,460 B1
(45) Date of Patent: May 4, 2021

(54) COLD PLANER DUST MITIGATION SYSTEM

(71) Applicant: Caterpillar Paving Products Inc., Brooklyn Park, MN (US)

(72) Inventors: Colton J. Hirman, Maple Grove, MN (US); Eric S. Engelmann, Delano, MN (US)

(73) Assignee: Caterpillar Paving Products Inc., Brooklyn Park, MN (US)

( * ) Notice: Subject to any disclaimer, the term of this patent is extended or adjusted under 35 U.S.C. 154(b) by 0 days.

(21) Appl. No.: 16/670,775

(22) Filed: Oct. 31, 2019

(51) Int. Cl.
*E01C 23/09* (2006.01)
*E01C 23/12* (2006.01)

(52) U.S. Cl.
CPC ..... *E01C 23/127* (2013.01); *E01C 2301/50* (2013.01)

(58) Field of Classification Search
CPC .... E01C 2301/50; E01C 23/088; E01C 23/09; E01C 23/12
USPC ..... 404/90, 93–94; 299/36.1, 39.1, 39.2, 299/39.4, 39.6
See application file for complete search history.

(56) References Cited

U.S. PATENT DOCUMENTS

| | | | | |
|---|---|---|---|---|
| 6,837,931 | B1 | 1/2005 | McGough | |
| 2012/0019045 | A1 | 1/2012 | Southern | |
| 2017/0284038 | A1* | 10/2017 | Laux | E01C 23/127 |
| 2019/0382968 | A1* | 12/2019 | Hirman | E01C 23/088 |

FOREIGN PATENT DOCUMENTS

| | | | | |
|---|---|---|---|---|
| CN | 1880018 | B | | 9/2011 |
| CN | 04297606 | U | | 4/2015 |
| CN | 207973969 | U | | 10/2018 |
| CN | 208103435 | U | | 11/2018 |
| CN | 208666600 | U | | 3/2019 |
| JP | 2013-2073 | A | * | 1/2013 |
| JP | 2017214786 | A | * | 12/2017 |
| KR | 2010109601 | A | | 10/2010 |

* cited by examiner

*Primary Examiner* — Sunil Singh
(74) *Attorney, Agent, or Firm* — von Briesen & Roper, s.c.

(57) ABSTRACT

The present disclosure is a dust mitigation system for a cold planer. The dust mitigation system may include the following components: a cutting drum; a conveyor system proximate to the cutting drum and adapted to collect cut paving material from the cutting drum and convey the cut paving material to a conveyor system exit; a fan proximate the conveyor system and directing dust from the cutting drum to the conveyor system; a conduit having a first end positioned in the cutting chamber and a second end proximate the fan; a water source; and a conveyor spray nozzle located between the fan and the conveyor system exit and adapted to communicate water from the water source on to the conveyor system such that the dust directed from the fan to the conveyor system is blown through the water.

18 Claims, 4 Drawing Sheets

COLD PLANER DUST MITIGATION SYSTEM

TECHNICAL FIELD

The present disclosure relates generally to milling machines and more specifically to cold planers.

BACKGROUND

In order to repair and resurface pavement such as on roads and in parking lots, the prior surface must often be removed. This is typically achieved by use of a heavy-duty milling machine known as a cold planer. A cold planer cuts the top layer of paving material with a rotating cutting drum having a plurality of radially extending cutting teeth arranged around the circumference of the cutting drum. The cutting drum rotates against the prior road surface and the cutting teeth dig into and tear apart the paved surface. The rotation of the drum also deposits the cut paving material onto a conveyor system which in turn conveys the cut paving material to a truck or similar haul vehicle for disposal.

During the above described milling process, airborne dust is produced as large and small pieces of cut material are forcefully created and tossed around by the cutting drum. This represents a potential issue with decreased air quality in the vicinity of the operator. Many cold planers have some form of dust mitigation, such as ventilation systems that create a vacuum to draw the dust away from the cutting drum and the operator. Many of these ventilation systems exhaust into the conveyor system. However, when dust is added to the conveyor system, it typically remains airborne dust. At the conveyor exit, depending on weather conditions, this airborne dust can be blown back towards the operator.

The prior art has failed to adequately address this issue. US Patent Application No. 2017/350080A1 to Hirman et al. discloses a cold planer ventilation system which utilizes a settling box and a fan to draw dust from the cutting drum and exhaust the dust into the conveyor system. However, further improvements may still be available.

SUMMARY OF THE DISCLOSURE

According to one aspect of the disclosure, a dust mitigation system for a cold planer is disclosed. The dust mitigation system may include the following components: a cutting drum; a conveyor system proximate to the cutting drum and adapted to collect cut paving material from the cutting drum and convey the cut paving material to a conveyor system exit; a fan proximate the conveyor system and directing dust from the cutting drum to the conveyor system; a conduit having a first end positioned in the cutting chamber and a second end proximate the fan; a water source; and a conveyor spray nozzle located between the fan and the conveyor system exit and adapted to communicate water from the water source on to the conveyor system such that the dust directed from the fan to the conveyor system is blown through the water.

According to another aspect of the disclosure, a cold planer machine is disclosed. The cold planer machine may include the following components: a frame; an engine; traction devices; an operator cab; a cutting drum; a conveyor system proximate to the cutting drum and adapted to collect cut paving material from the cutting drum and convey the cut paving material to a conveyor system exit; a fan proximate the conveyor system and directing dust from the cutting drum to the conveyor system; a conduit having a first end positioned in the cutting chamber and a second end proximate the fan; a water source; and a conveyor spray nozzle located between the fan and the conveyor system exit and adapted to communicate water from the water source on to the conveyor system such that the dust directed from the fan to the conveyor system is blown through the water According to yet another aspect of the disclosure, a method for dust mitigation is disclosed. The method may comprise: creating dust while cutting paving material with a cutting system of the cold planer; collecting the dust with a conduit; conveying the dust through the conduit using a fan; discharging the dust from the conduit onto a conveyor system; and spraying the dust on the conveyor system with a water spray from a spray nozzle.

These and other aspects and features of the present disclosure will be more readily understood after reading the following detailed description in conjunction with the accompanying drawings.

DETAILED DESCRIPTION

Figure 1:
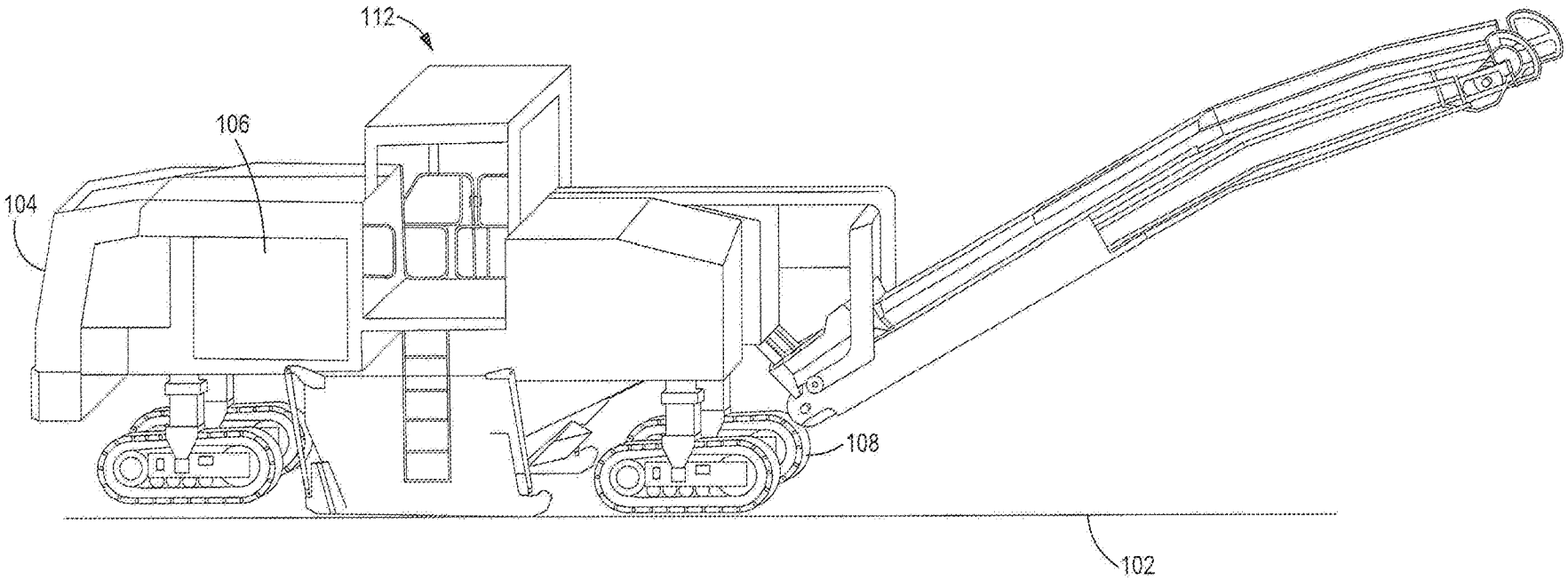
FIG. 1 is a perspective view of a cold planer, according to one embodiment of the present disclosure.

Referring now to the drawings, and with specific reference to FIG. 1, a cold planer constructed in accordance with the present disclosure is shown referred to by reference numeral 100. A cold planer 100 may be used to prepare an old or damaged roadway or other paved surface for repairs. It does so by breaking and removing layers of hardened paving material such as asphalt or concrete from a surface 102. Once broken, the pieces 103 of paved surface are collected by a conveyor system and conveyed to a transport vehicle for disposal or recycling.

Figure 2:
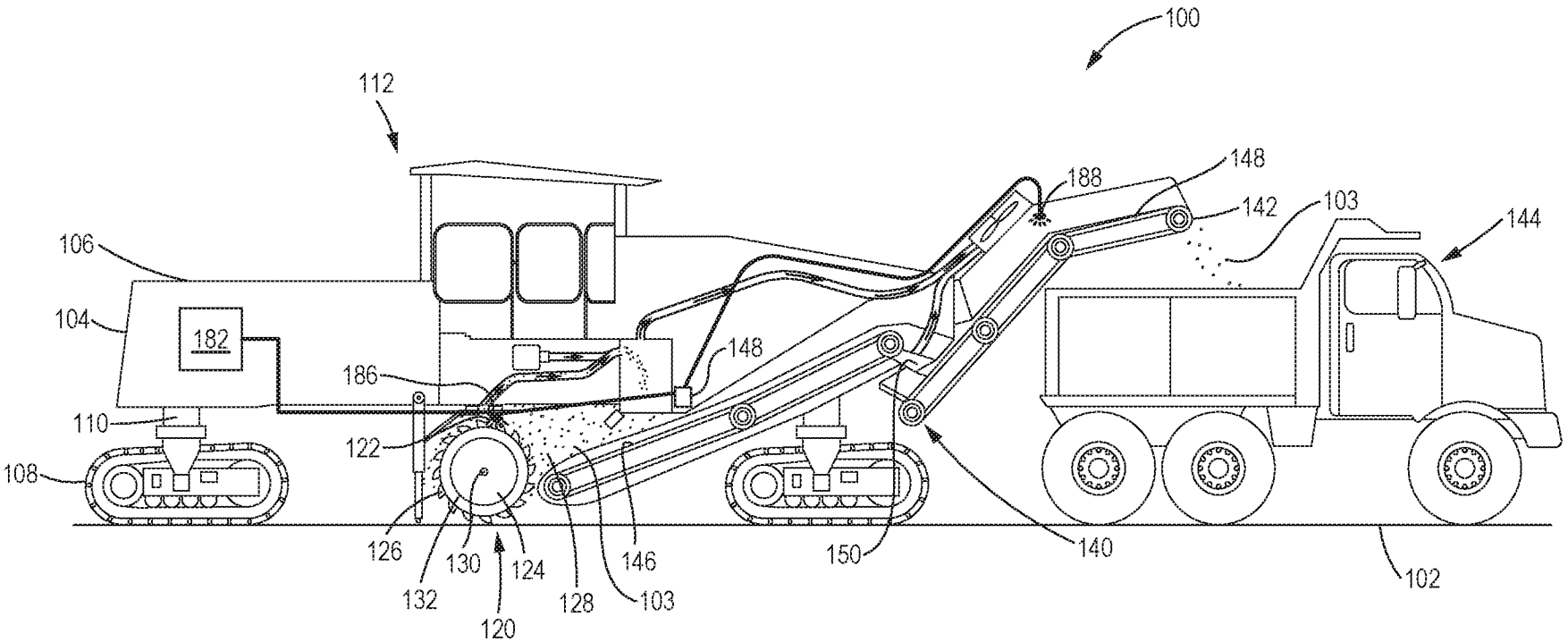
FIG. 2 is a schematic diagram of a cold planer and haul vehicle 103 according to one embodiment of the present disclosure.

As shown in FIG. 2, the cold planer 100 further includes a frame 104, an engine 106 mounted to the frame 104, and at least one traction device 108 which supports the frame 104. The traction device 108 may be provided in various ways, including but not limited to wheels, treads, or the like which enable the cold planer 100 to engage the ground 102 and move. The traction device 108 may be connected to and support the frame 104 by hydraulic legs 110 or other adjustable methods that allow the cold planer 100 to be moved up and down. The cold planer 100 may be controlled by an operator (not shown) located within an operator cabin 112.

The cold planer 100 also includes a cutting system 120. The cutting system 120 includes a hood 122 disposed beneath the frame 104, a cutting drum 124, and a plurality of cutting tools 126. The hood 122 may partially enclose the cutting drum 124 and defines a cutting chamber 128. The cutting drum 124 may receive power from the engine 106. The cutting drum 124 has a central axis 130 about which the cutting drum 124 rotates, and an outer circumference 132.

When provided with power, the cutting drum 124 rotates about the central axis 130 within the cutting chamber 128.

The plurality of cutting tools 126 may be disposed around and radially extend from the outer circumference 132 of the cutting drum 124. The plurality of cutting tools 126, also referred to as bits, are configured to cut the paved surface 102 as is known in the art. More specifically, as the cutting drum 124 rotates, the plurality of cutting tools 126 make repeated contact with the paved surface 102, breaking the surface 102 into pieces 103 and transporting the pieces 103 to a conveyor system 140. The height of the cutting drum 124 may be adjusted to remove a specific depth of material by raising or lowering the cold planer 100 with the hydraulic legs 110. In one embodiment, the cutting system 120 may be adjusted to remove between 1 and 13 inches of material, but of course, such dimensions are merely exemplary and other depths are possible.

In order to collect paving material produced during breaking up of the paved surface 102 by the cutting drum 126, a conveyor system 140 is provided on the cold planer 100. The conveyor system 140 transports the collected material to a conveyor system exit 142 which deposits the material into a discharge location, such as a bed of a transport vehicle 144, which may be a haul truck, or any other type of transport vehicle known in the art.

As subsets of the conveyor system 140, a pickup conveyor 146 and a discharge conveyor 148 may be provided as explained below. The pickup conveyor 146 and the discharge conveyor 148 converge at a conveyor transfer chamber 150. The pickup conveyor 146 is configured to collect paving material from the cutting drum 124 and transport the material to the discharge conveyor 148. The discharge conveyor 148 is configured to collect the material from the exit of the pickup conveyor 146 in the conveyor transfer chamber 150 and transport the material to the conveyor system exit 142. In various embodiments, the discharge conveyor 148 may be hydraulically movable relative to the pickup conveyor 146 in a vertical and/or a horizontal direction so as to adjust the discharge conveyor 148 relative to the desired discharge location 144.

Figure 3:
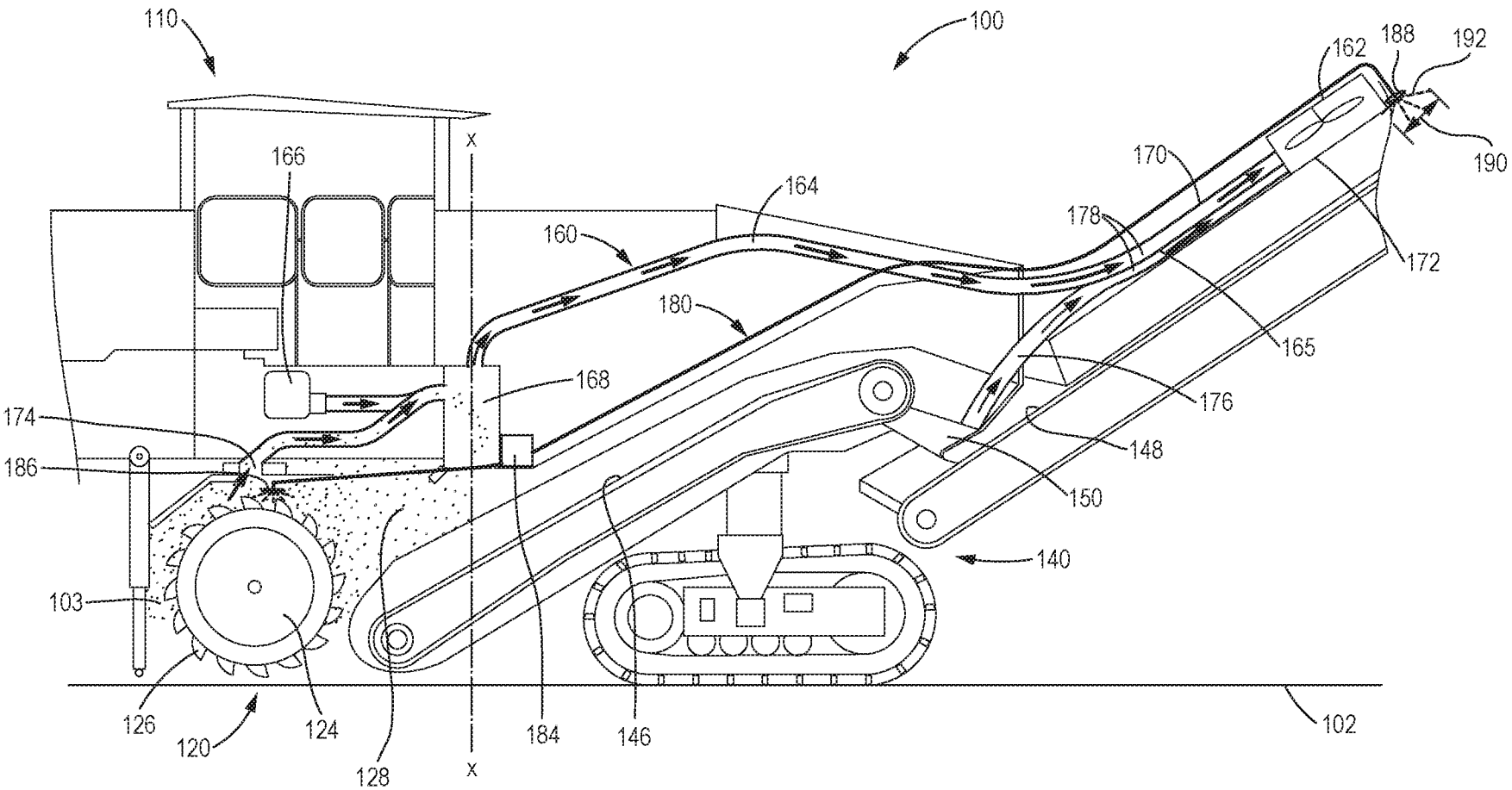
FIG. 3 is an enlarged view of a section of FIG. 2 showing ventilation and water systems according to the present disclosure.

FIG. 3 shows the front section of the cold planer in more detail, in particular a ventilation system 160 and a water system 180 of the cold planer 100. The cold planer 100 further includes a ventilation system 160 which collects dust from the cutting system 120 and transports it to the conveyor system 140. In so doing, the volume of dust to which the operator is exposed is lessened. The ventilation system 160 includes a fan 162 and at least one conduit 164 or suction hose. The ventilation system 160 may also include other features such as a secondary fan 166 or settling box 168. The fan 162 has a suction side 170 and an exhaust side 172. A first conduit 164 has a first end 174 configured to collect dust from the cutting chamber 128. For example, the first end 174 may be positioned at the entrance of the pickup conveyor 148 within the cutting chamber 128. A second conduit 165 may have a first end 176 positioned to collect dust in the conveyor transfer chamber 150 between the pickup conveyor 146 and the discharge conveyor 148. The second ends 178 may then be attached to the suction side 170 of the fan 162. The fan exhaust 172 may be positioned such that it discharges collected dust into the discharge conveyor 148. In one embodiment, the fan 162 may create an air flow rate in the ventilation system 160 of 40-45 cubic meters per minute (CMM) at full speed. Of course, other air flow rates are possible and in no way limit the scope of the present disclosure.

In order to cool the cutting system and further mitigate dust, the cold planar 100 also includes a water system 180. The water system 180 includes a water tank 182 positioned on the frame 104 proximate to the cutting drum 124 and conveyor system 140. The tank 182 is configured to hold a predetermined amount of water and provide water to water nozzles 186,188 via a water pump 184. In various embodiments, some of the water nozzles 186 may be directed towards the cutting chamber 128 to prevent overheating of the cutting drum 124 and cutting tools 126 and/or reduce dust.

In a significant departure from the prior art, the present disclosure further provides at least one of the water nozzles 186 as a conveyor spray nozzle 188, positioned to spray into the discharge conveyor 148. In so doing, the water system 180 facilitates containment of the dust generated by the cold planer 100 and mitigates the volume of dust released to the ambient air. More specifically, the water engages the dust and weighs the dust down to the conveyor 148 so as to deter the dust becoming airborne. The conveyor spray nozzles 188 are positioned between the fan exhaust 172 and the conveyor system exit 142. The conveyor spray nozzles 188 are configured such that the discharging dust is blown through the water spray as it enters the discharge conveyor 148. In various embodiments, the spray nozzles 188 may be positioned at the fan exhaust 172. In other embodiments, the spray nozzles 188 may be positioned at the conveyor system exit 142.

Depending on the size of the cold planer involved, the material being cut, and weather conditions, it may be desirable to adjust the volume of water or spread diameter of the water spray being generated by the nozzles. Accordingly, a width 190 of the water plume 192 generated by the conveyor spray nozzles 188 can be provided in a range of dimensions. For example, in one embodiment, the conveyor spray nozzles 152 may have a 120-degree fan spray. Moreover, the water flow rate may vary as necessary to most effectively contain the dust. In one embodiment the water flow rate may range from 0.35-0.77 GPM. Of course, other types of nozzles and other flow rates are possible.

INDUSTRIAL APPLICABILITY

In operation, the disclosed dust mitigation system and method may be used with cold planers and other similar milling machines in which control of dust is desired. Among other advantages, the system removes airborne dust from the exit of the discharge conveyor which may otherwise be blown towards the machine operator. As a result, the air quality in the vicinity of the operator may be improved.

Figure 4:
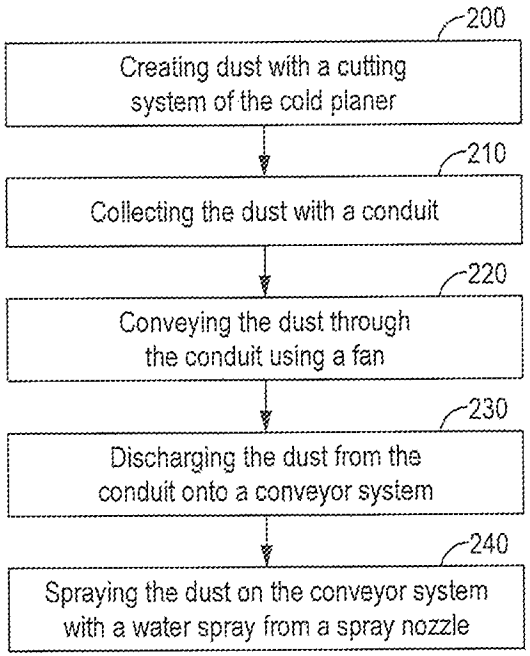
FIG. 4 is a flowchart depicting a sample sequence of steps for a method of dust mitigation in a cold planer according to the present disclosure.

FIG. 4 describes a method of dust mitigation as presently disclosed. In a first step, indicated by reference numeral 200, dust is created during operation of the cold planer 100 as the cutting system 100 cuts paving material. This dust is collected by the conduits 164, as shown in step 210, and conveyed to the fan exhaust 172 as shown by step 220. Referring now to step 230, the collected dust is discharged from the fan exhaust 172 into the conveyor system 140 to be removed from the cold planer 100. At least one conveyor spray nozzle 188 sprays the dust to damp it down and prevent it from remaining airborne as the dust exists the conveyor system 140, as shown in step 240. The dust is blown through the water spray. Because the dust is no longer airborne, it is less likely to be blown back into the vicinity of the operator. As a result, the air quality around the operator is improved.

While the preceding text sets forth a detailed description of numerous different embodiments, it should be understood that the legal scope of protection is defined by the words of the claims set forth at the end of this patent. The detailed description is to be construed as exemplary only and does not describe every possible embodiment since describing every possible embodiment would be impractical, if not impossible. Numerous alternative embodiments could be implemented, using either current technology or technology developed after the filing date of this patent, which would still fall within the scope of the claims defining the scope of protection.

What is claimed is:

1. A dust mitigation system for a cold planar, comprising:

a cutting drum;

a conveyor system proximate to the cutting drum and adapted to collect cut paving material from the cutting drum and convey the cut paving material to a conveyor system exit, the conveyor system including a conveyor transfer chamber positioned between the cutting drum and the conveyor system exit;

a fan proximate the conveyor system and directing dust from the cutting drum to the conveyor system;

a first conduit having a first end positioned proximate the cutting drum and a second end proximate the fan;

a second conduit having a first end proximate to and in communication with the conveyor transfer chamber and a second end proximate the fan;

a water source; and a conveyor spray nozzle located between the fan and the conveyor system exit and adapted to communicate water from the water source on to the conveyor system such that the dust directed from the fan to the conveyor system is blown through the water.

2. The system of claim 1, wherein the conveyor spray nozzle is positioned proximate to the conveyor system exit.

3. The system of claim 1, wherein the conveyor spray nozzle is positioned proximate to the fan.

4. The system of claim 1, wherein the conveyor spray nozzles is configured to provide a 120 degree fan spray.

5. The system of claim 1, wherein the conveyor system further comprises a pickup conveyor and a discharge conveyor, the pickup conveyor being proximate to the cutting drum and adapted to collect the cut paving material from the cutting drum, the pickup conveyor and the discharge conveyor converging in the conveyor transfer chamber, and the discharge conveyor adapted to collect the cut paving material from the pickup conveyor.

6. The system of claim 5, wherein the fan directs the dust onto the discharge conveyor.

7. A cold planer, comprising:

an undercarriage;

an engine mounted on the undercarriage;

at least one traction device supporting the undercarriage;

an operator cabin supported by the undercarriage;

a cutting drum;

a conveyor system proximate to the cutting drum and adapted to collect cut paving material from the cutting drum and convey the cut paving material to a conveyor system exit, the conveyor system including a conveyor transfer chamber positioned between the cutting drum and the conveyor system exit;

a fan proximate the conveyor system and directing dust from the cutting drum to the conveyor system;

a first conduit having a first end positioned proximate the cutting drum and a second end proximate the fan;

a second conduit having a first end proximate to and in communication with the conveyor transfer chamber and a second end proximate the fan;

a water source; and a conveyor spray nozzle located between the fan and the conveyor system exit and adapted to communicate water from the water source on to the conveyor system such that the dust directed from the fan to the conveyor system is blown through the water.

8. The machine of claim 7, wherein the conveyor spray nozzle is positioned proximate to the conveyor system exit.

9. The machine of claim 7, wherein the conveyor spray nozzle is positioned proximate to the fan.

10. The machine of claim 7, wherein the conveyor spray nozzles is configured to provide a 120 degree fan spray.

11. The machine of claim 7, wherein the conveyor system further comprises a pickup conveyor and a discharge conveyor, the pickup conveyor being proximate to the cutting drum and adapted to collect the cut paving material from the cutting drum, the pickup conveyor and the discharge conveyor converging in the conveyor transfer chamber, and the discharge conveyor adapted to collect the cut paving material from the pickup conveyor.

12. The machine of claim 11, wherein the fan directs the dust onto the discharge conveyor.

13. A method of dust mitigation for a cold planar having a conveyor system including a conveyor transfer chamber positioned between the cutting drum and the conveyor system exit, comprising:

cutting paving material with a cutting system of the cold planer, the cutting system producing dust;

collecting the dust from the cutting system with a first conduit;

collecting the dust from the conveyor transfer chamber with a second conduit;

conveying the dust through the first conduit and the second conduits using a fan;

discharging the dust from the first and the second conduits onto the conveyor system; and blowing the dust on the conveyor system through a water spray from a spray nozzle.

14. The method of claim 13, wherein the conveyor spray nozzle is positioned proximate to the fan.

15. The method of claim 13, wherein the conveyor spray nozzle is configured to provide a 120 degree fan spray.

16. The method of claim 13, wherein the conveyor system further comprises a pickup conveyor and a discharge conveyor, the pickup conveyor being proximate to the cutting drum and adapted to collect the cut paving material from the cutting drum, the pickup conveyor and the discharge conveyor converging in the conveyor transfer chamber, and the discharge conveyor adapted to collect the cut paving material from the pickup conveyor.

17. The method of claim 16, wherein the second conduit has a first end proximate the conveyor transfer chamber and a second end proximate the fan.

18. The method of claim 16, wherein the fan directs the dust onto the discharge conveyor.

* * * * *